US005388560A

United States Patent [19]

Hisaki et al.

[11] Patent Number: 5,388,560

[45] Date of Patent: * Feb. 14, 1995

[54] MISFIRE-DETECTING SYSTEM FOR INTERNAL COMBUSTION ENGINES

[75] Inventors: Takashi Hisaki; Yuichi Shimasaki; Shigeki Baba; Masaki Kanehiro; Takuji Ishioka; Shigeru Maruyama; Kazuhito Kakimoto; Masataka Chikamatsu; Shukoh Terata; Kenichi Maeda, all of Wako, Japan

[73] Assignee: Honda Giken Kogyo Kabushiki Kaisha, Tokyo, Japan

[ * ] Notice: The portion of the term of this patent subsequent to Sep. 7, 2010 has been disclaimed.

[21] Appl. No.: 51,705

[22] Filed: Apr. 26, 1993

[30] Foreign Application Priority Data

Apr. 28, 1992 [JP] Japan ..... 4-136019

[51] Int. Cl.[6] ..... F02P 11/00

[52] U.S. Cl. ..... 123/630; 123/425

[58] Field of Search ..... 123/630, 479, 148 F, 123/481; 324/388, 399, 380, 378; 73/117.3, 116

[56] References Cited

U.S. PATENT DOCUMENTS 5,215,067 6/1993 Shimasaki et al. ..... 123/630
5,226,394 7/1993 Shimasaki et al. ..... 123/479
5,241,937 9/1993 Kanehiro et al. ..... 123/630

*Primary Examiner*—Raymond A. Nelli
*Attorney, Agent, or Firm*—Nikaido, Marmelstein, Murray & Oram

[57] ABSTRACT

A misfire-detecting system for an internal combustion engine compares detected sparking voltage with a first predetermined comparative level and a second predetermined comparative level lower than the first predetermined comparative level. Whether a misfire has occurred in the engine is determined based upon a logical relationship between results of the comparisons. As a result, a misfire can be detected accurately even when dielectric breakdown of the mixture occurs while a misfire has occurred.

9 Claims, 10 Drawing Sheets

T1
T2
A
t0
t1 t2

TG
G
t3
t4
V
VCOMP
VCOMP1

VCOMP2
0
t0
t5 t2
TMFPLSM
B

MFPLSM
t6 t7
t2 t8
T3

MFPLSS
t2 t8'

BS

V
VCOMP
0
t3
t0
t9
t10
t5
t2
t11
t12
VCOMP1
VCOMP2
B'
B"
TMFPLSM
MFPLSM
MFPLSS
LOW LEVEL
BS

MISFIRE-DETECTING SYSTEM FOR INTERNAL COMBUSTION ENGINES

BACKGROUND OF THE INVENTION

1. Field of the Invention

This invention relates to a misfire-detecting system for internal combustion engines, and more particularly to a misfire-detecting system which detects a misfire attributable to a fuel supply system of the engine.

2. Prior Art

In an internal combustion engine having spark plugs, a misfire can occur, in which normal ignition does not take place at one or more of the spark plugs. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called misfiring), i.e. normal spark discharge does not take place at the spark plug, for example, due to smoking of the spark plug or wetting thereof with fuel or abnormality in the sparking voltage supply system.

The present assignee has already proposed a misfire-detecting system for detecting misfires attributable to the fuel supply system, which comprises sparking voltage-detecting means which detects sparking voltage, i.e. voltage across electrodes of the spark plug, based upon an ignition command signal, and misfire-determining means which determines that a misfire has occurred based on the detected value of the sparking voltage, e.g. when a time period over which the detected value of the sparking voltage exceeds a predetermined reference value (Japanese Patent Application No. 3-326507 and corresponding U.S. Ser. No. 07/846,238 filed Mar. 5, 1992).

Further, the present assignee has proposed a misfire-detecting system which is an improved version of the above-mentioned misfire-detecting system, which comprises recharging means for recharging the ignition coil to again generate high voltage across the spark plug after generation of the ignition command signal, measuring means for measuring by a counter a time period over which the sparking voltage exceeds a predetermined time period immediately after the recharging, and misfire-determining means for determining that a misfire has occurred in the engine if the measured time period exceeds a predetermined time period (Japanese Patent Application No. 4-93775 filed Mar. 19, 1992).

However, this proposed misfire-detecting system has the disadvantage that when dielectric breakdown of a mixture supplied to the cylinder occurs due to the recharging, it can happen that the time period over which the sparking voltage exceeds the predetermined voltage, does not exceed the predetermined time period even when a misfire has occurred, resulting in a misjudgment on the occurrence of a misfire.

SUMMARY OF THE INVENTION

It is an object of the invention to provide a misfire-detecting system for an internal combustion engine, which is capable of accurately detecting a misfire of the engine, even when dielectric breakdown of the mixture again occurs.

It is another object of the invention to provide a misfire-detecting system for an internal combustion engine, which is capable of accurately detecting a misfire irrespective of external disturbances such as noise.

To attain the first-mentioned object, the present invention provides a misfire-detecting system for an internal combustion engine having at least one spark plug, comprising:

engine operating parameter-detecting means for detecting operating parameters of the engine;

ignition command signal-generating means for determining ignition timing based on the detected operating parameters of the engine and for generating an ignition command signal at the ignition timing;

igniting means responsive to the ignition command signal for generating high voltage for causing electric discharge of the at least one spark plug;

sparking voltage-detecting means for detecting sparking voltage when the high voltage is generated by the igniting means;

first comparator means for comparing the detected sparking voltage with a first predetermined comparative level;

second comparator means for comparing the detected sparking voltage with a second predetermined comparative level which is lower than the first predetermined comparative level; and misfire-determining means for determining whether a misfire has occurred in the engine, based upon a logical relationship between results of the comparisons by the first and second comparator means.

In a preferred embodiment of the invention, the misfire-determining means comprises invertor means for inverting an output from one of the first and second comparator means, and AND means for determining a conjunction (AND) between the inverted output from the one of the first and second comparator means and an output from the other comparator means.

According to the above arrangement of the invention, when normal firing of the mixture occurs, the sparking voltage caused by recharging of the ignition coil declines gently and early, and accordingly the width of an output pulse from the first comparator means is relatively short. On this occasion, the width of an output pulse from the second comparator means which compares the sparking voltage with the second predetermined comparative level lower than the first predetermined comparative level is longer than that of the first comparator means. Consequently, there occurs a difference between the results of the comparisons by the first and second comparator means, for a time period corresponding to the difference between the output pulse widths. The misfire-determining means detects a logical relationship between the comparison results to thereby determine that normal firing has occurred.

On the other hand, when there occurs no dielectric breakdown of the mixture while a misfire has occurred, the first comparator means generates an output having a relatively long pulse width, which is detected by the misfire-determining means to determine that a misfire has occurred. When dielectric breakdown of the mixture has occurred while a misfire has occurred, the sparking voltage declines very quickly at an early time so that there is almost no difference in the width of outputs from the first and second comparator means and hence the comparison results become identical with each other. The misfire-determining means detects the resulting logical relationship, to determine that a misfire has occurred.

To attain the second object, the present invention provides a misfire-detecting system which comprises:

first comparator means for comparing the detected sparking voltage with a first predetermined comparative level;

second comparator means for comparing the detected sparking voltage with a second predetermined comparative level which is lower than the first predetermined comparative level;

first measuring means for measuring a first time period over which the output from the first comparator means indicates that the detected sparking voltage exceeds the first predetermined comparative level;

second measuring means for measuring a second time period over which the output from the second comparator means indicates that the detected sparking voltage exceeds the second predetermined comparative level; and misfire-determining means for determining whether a misfire has occurred, based upon a difference between the first and second time periods measured by the first and second measuring means.

According to this arrangement, the first and second measuring means measure, respectively, the first and second time periods, and the misfire-determining means determines that normal firing has occurred when the difference between the first and second time periods is larger than the predetermined value, and determines that a misfire has occurred (while at the same time dielectric breakdown of the mixture has occurred) when the difference is smaller than the predetermined value.

Preferably, the misfire-detecting system according to the invention includes comparison time-limiting means for limiting a time period within which the comparisons by the first and second comparator means are to be carried out, and wherein the misfire-determining means carries out the determination as to occurrence of a misfire within the limited time period.

Further, the misfire-detecting system according to the invention includes recharging means for applying recharging voltage to the at least one spark plug after generation of the ignition command signal, the recharging voltage having such a voltage value as does not cause electric discharge of the at least one spark plug.:

The above and other objects, features, and advantages of the invention will become more apparent from the following detailed description taken in conjunction with the accompanying drawings.

BRIEF DESCRIPTION OF THE DRAWINGS

FIG. 5*a* to FIG. 5*f* collectively form a timing chart which is useful in explaining the operation of the misfire-determining circuit at normal firing, in which:

FIG. 5*a* shows an energization control signal (ignition command, signal) A;

FIG. 5*b* shows a gating signal G;

FIG. 5*c* shows changes in comparative levels VCOMP1 and VCOMP2 at normal firing to be compared with sparking voltage V;

FIG. 5*d* shows an output from a first comparator in FIG. 2;

FIG. 5*e* shows an output from a second comparator in FIG. 2; and

FIG. 5*f* shows a determination result signal BS;

FIG. 6*a* to FIG. 6*d* collectively form a timing chart which is useful in explaining the operation of the misfire-detecting circuit at a misfire, in which:

FIG. 6*a* shows changes in the comparative levels VCOMP1 and VCOMP2 at a misfire;

FIG. 6*b* shows an output from the first comparator, which is obtained at the misfire;

FIG. 6*c* shows an output from the second comparator, which is obtained at the misfire; and FIG. 6*d* shows the determination result signal BS, which is obtained at the misfire.

FIG. 7*a* and FIG. 7*d* collectively form a timing chart which is useful in explaining the manner of detecting a misfire when dielectric breakdown of the mixture occurs, according to the invention, in which:

FIG. 7*a* shows changes in the comparative voltage levels VCOMP1 and VCOMP2 assumed when dielectric breakdown of the mixture occurs, FIG. 7*b* shows an output from the first comparator in FIG. 2;

FIG. 7*c* shows an output from the second comparator in FIG. 2; and

FIG. 7*d* shows the determination result signal BS;

DETAILED DESCRIPTION

The invention will now be described in detail with reference to the drawings showing embodiments thereof.

Figure 1:
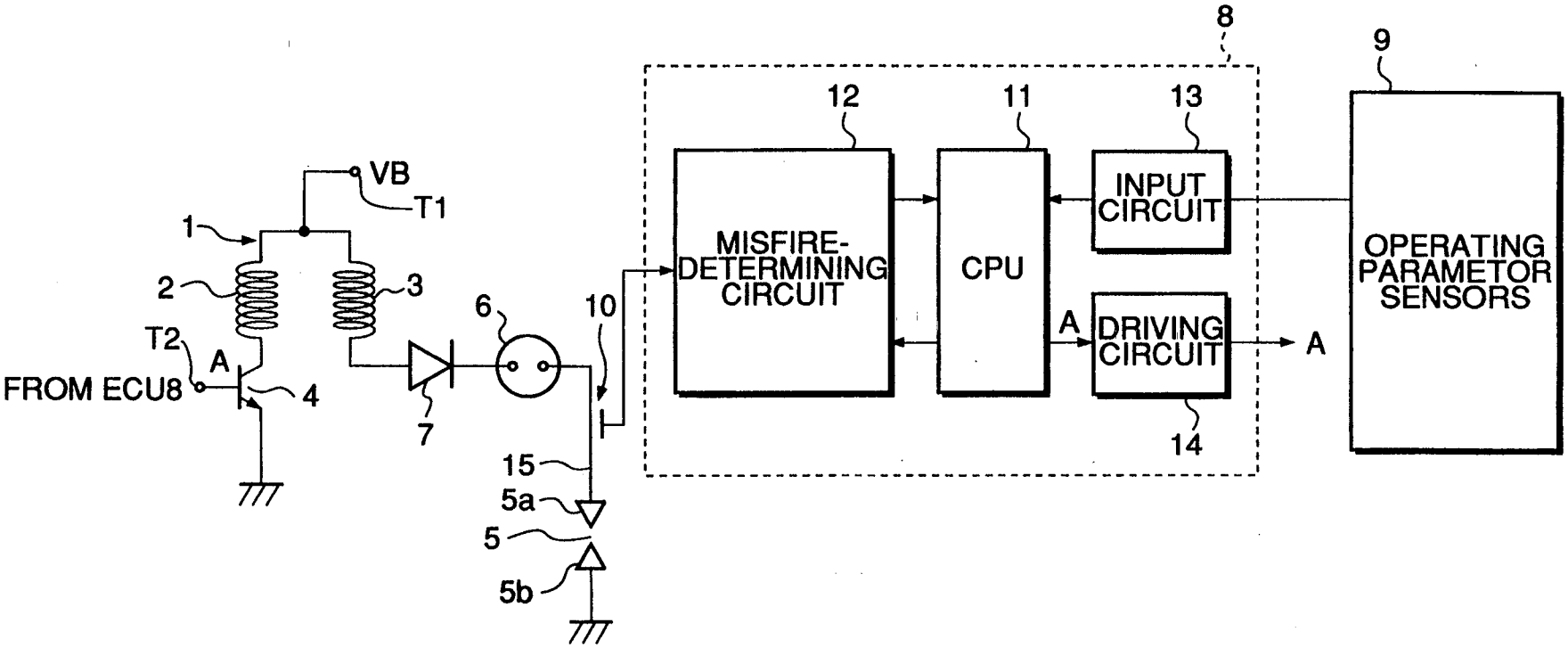
FIG. 1 is a block diagram showing the whole arrangement of a misfire-detecting system for an internal combustion engine, according to a first embodiment of the invention.

Referring first to FIG. 1, there is shown the arrangement of a misfire-detecting system according to a first embodiment of the invention, which is incorporated in an internal combustion engine. A feeding terminal T1, which is supplied with supply voltage VB for the ignition device 16 from a battery, not shown, is connected to an ignition coil 1 comprised of a primary coil 2 and a secondary coil 3, the ignition coil 1 being provided in each of cylinders of the engine which is a four cylinder type, for example. The primary and secondary coils 2, 3 are connected with each other at ends thereof. The other end of the primary coil 2 is connected to a collector of a transistor 4. The transistor 4 has its base connected to an input terminal T2 through which is supplied an ignition command signal A from an electronic control unit (hereinafter referred to as "the ECU") 8, to be supplied with the ignition command signal A. The other end of the secondary coil 3 is connected to an anode of a diode 7, which in turn has its cathode connected via a distributor 6 to a center electrode 5*a* of each spark plug 5. The spark plug 5 has its grounding electrode 5*b* grounded.

A sparking voltage sensor 10 is provided at an intermediate portion of a connecting line 15 which connects between the distributor 6 and the center electrode 5*a*. The sensor 10 is electrostatically coupled to the connecting line 15 and forms together therewith a capacitance of several pF's, and its output is connected to a misfire-determining circuit 12 of the ECU 8. The misfire-determining circuit 12 is connected to a central processing unit (hereinafter referred to as "the CPU") 11 to supply results of its determination of a misfire thereto. The CPU 11 carries out timing control related to the misfire determination.

Connected to the CPU 11 are various operating parameter sensors, generically designated by reference numeral 9, which sense various operating parameters of the engine including engine rotational speed NE and supply the sensed values of the operating parameters to the CPU 11 via an input circuit 13. The CPU 11 is connected to the base of the transistor 4 via a driving circuit 14 to supply the ignition command signal A as an energization control signal to the transistor 4.

Figure 2:
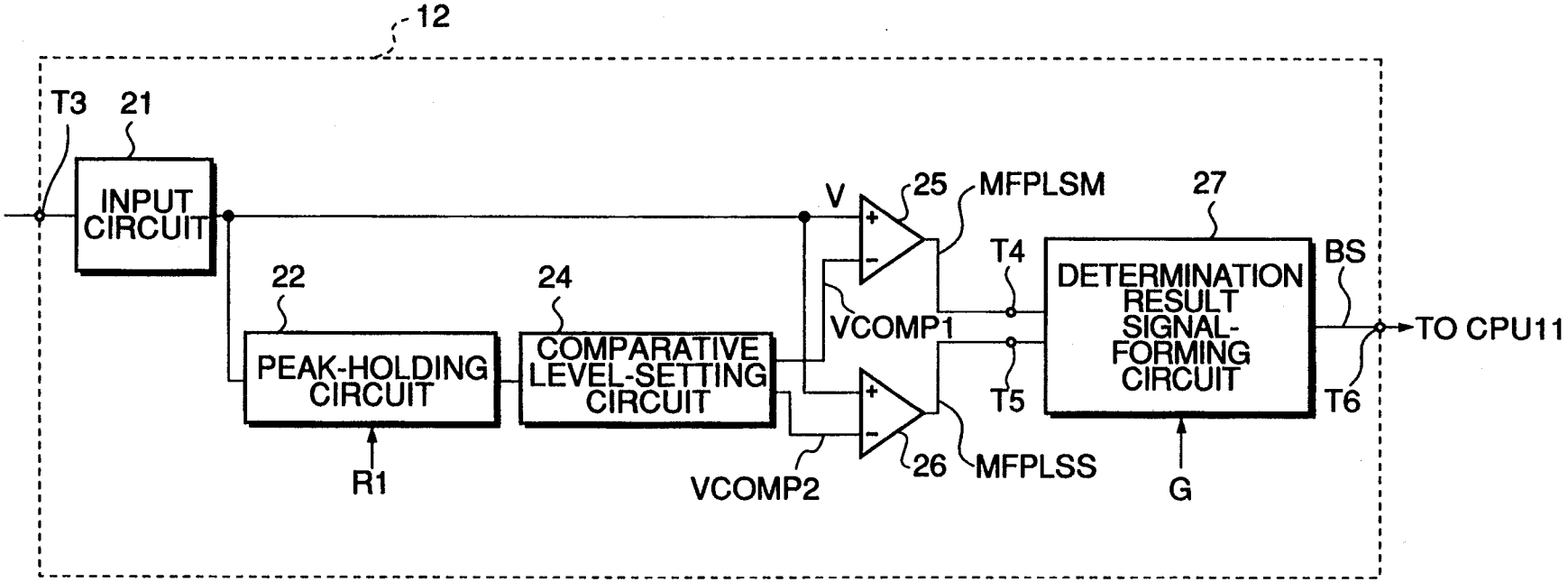
FIG. 2 is a circuit diagram showing details of a misfire-determining circuit appearing in FIG. 1.

FIG. 2 shows details of the misfire-determining circuit 12. An input terminal T3 thereof is connected via an input circuit 21 to non-inverting input terminals of first and second comparators 25 and 26, as well as to an input of a peak-holding circuit 22. The output of the peak-holding circuit 22 is connected via a comparative level-setting circuit 24 to inverting input terminals of the first and second comparators 25, 26. The peak-holding circuit 22 is supplied with a resetting signal R1 from the CPU 11 for resetting at an appropriate time a peak value of the sparking voltage held by the peak-holding circuit 22.

Further, the first and second comparators 25, 26 have their outputs connected via respective terminals 4 and 5 to a determination result signal-forming circuit 27, which in turn has its output connected via a terminal T6 to the CPU 11 to supply a determination result signal BS thereto.

Figure 3:
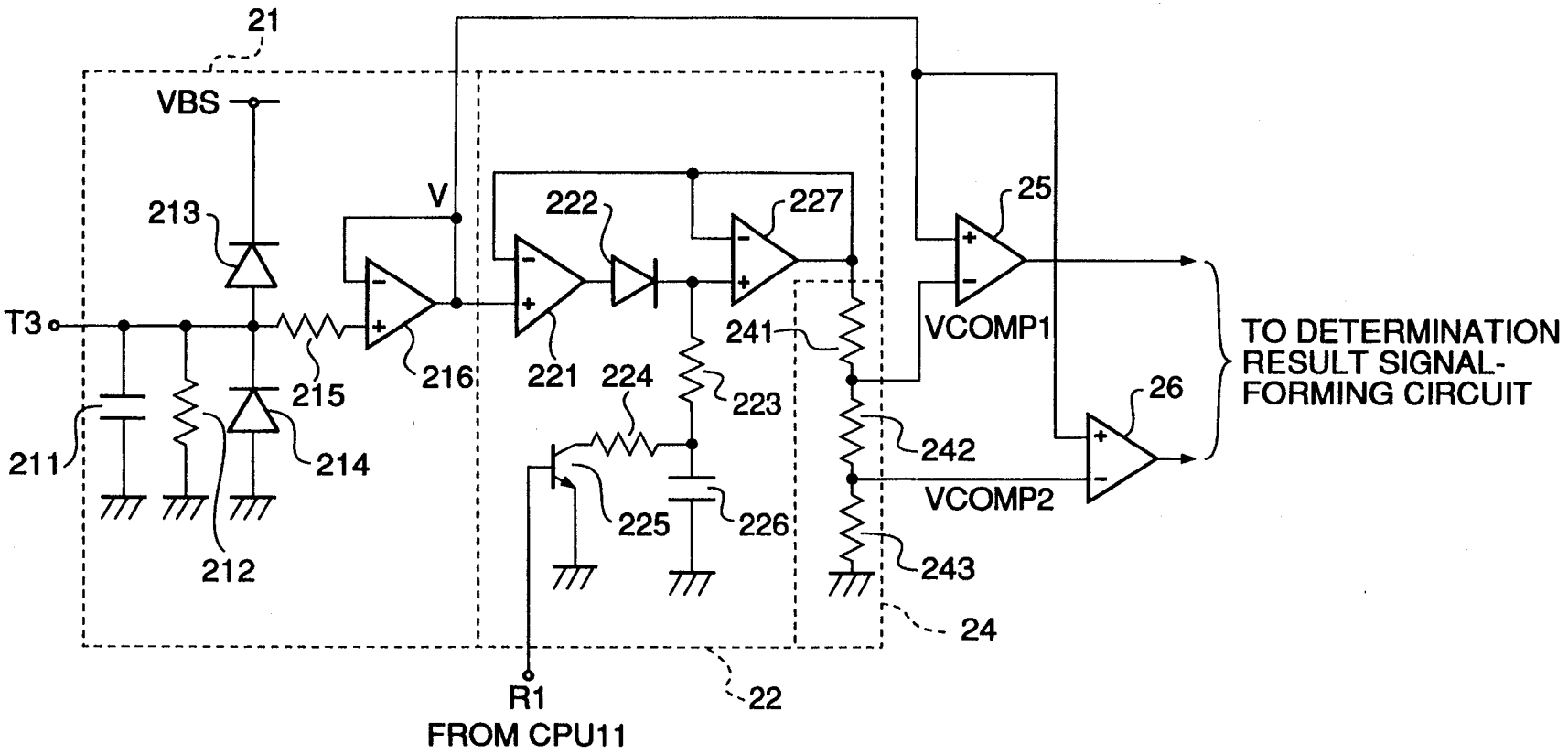
FIG. 3 is a circuit diagram showing details of parts of the misfire-determining circuit.

FIG. 3 shows details of the input circuit 21, the peak-holding circuit 22 and the comparative level-setting circuit 24 in FIG. 2. As shown in the figure, an input terminal T3 is connected to a non-inverting input terminal of an operational amplifier 216 via a resistance 215. The input terminal T3 is grounded via a circuit formed of a capacitor 211, a resistance 212, and a diode 214, which are connected in parallel, and connected to a supply voltage-feeding line VBS via a diode 213.

The capacitor 211 has a capacitance of $10^4$pF, for example, and serves to divide voltage detected by the sparking voltage sensor 13 into one over several thousands. The resistance 212 has a value of 500 KΩ, for example. The diodes 213 and 214 act to control the input voltage to the operational amplifier 216 to a range of 0 to VBS. An inverting input terminal of the operational amplifier 216 is connected to the output of the same so that the operational amplifier 216 operates as a buffer amplifier (impedance converter).

The output of the operational amplifier 216 is connected to the non-inverting input terminal of the first comparator 25 as well as to a non-inverting input terminal of an operational amplifier 221. The output of the operational amplifier 221 is connected to a non-inverting input terminal of an operational amplifier 227 via a diode 222, with inverting input terminals of the amplifiers 221, 227 both connected to the output of the amplifier 227. Therefore, these operational amplifiers form a buffer amplifier.

The non-inverting input terminal of the operational amplifier 227 is grounded via a resistance 223 and a capacitor 226, the junction therebetween being connected to a collector of a transistor 225 via a resistance 224. The transistor 225 has its emitter grounded and its base supplied with the resetting signal R1 from the CPU 11. The resetting signal R1 goes high when resetting is to be made.

The output of the operational amplifier 227 is grounded via resistances 241, 242 and 243 forming the comparative level-setting circuit 24, the junction between the resistances 241, 242 being connected to the inverting input terminal of the first comparator 25 and the junction between the resistances 242, 243 being connected to the inverting input terminal of the second comparator 26. The non-inverting input terminals of the first and second comparators 25, 26 are connected to each other.

The circuit of FIG. 3 operates as follows: A peak value of the detected sparking voltage V (output from the operational amplifier 216) is held by the peak-holding circuit 22, the held peak value is multiplied by predetermined values smaller than 1 by the comparative level-setting circuit 24, and the resulting products are applied, respectively, to the first and second comparators 25, 26 as comparative levels VCOMP1 and VCOMP2. Thus, pulse signals MFPLSM, MFPLSS indicative of the comparison results, which go high, respectively, when V>VCOMP1 and V>VCOMP2 stand, are outputted from the first and second comparators 25, 26 through the terminals T4, T5. In the present embodiment, the comparative levels VCOMP1, VCOMP2 are set such that VCOMP1 is higher than VCOMP2.

Figure 4:
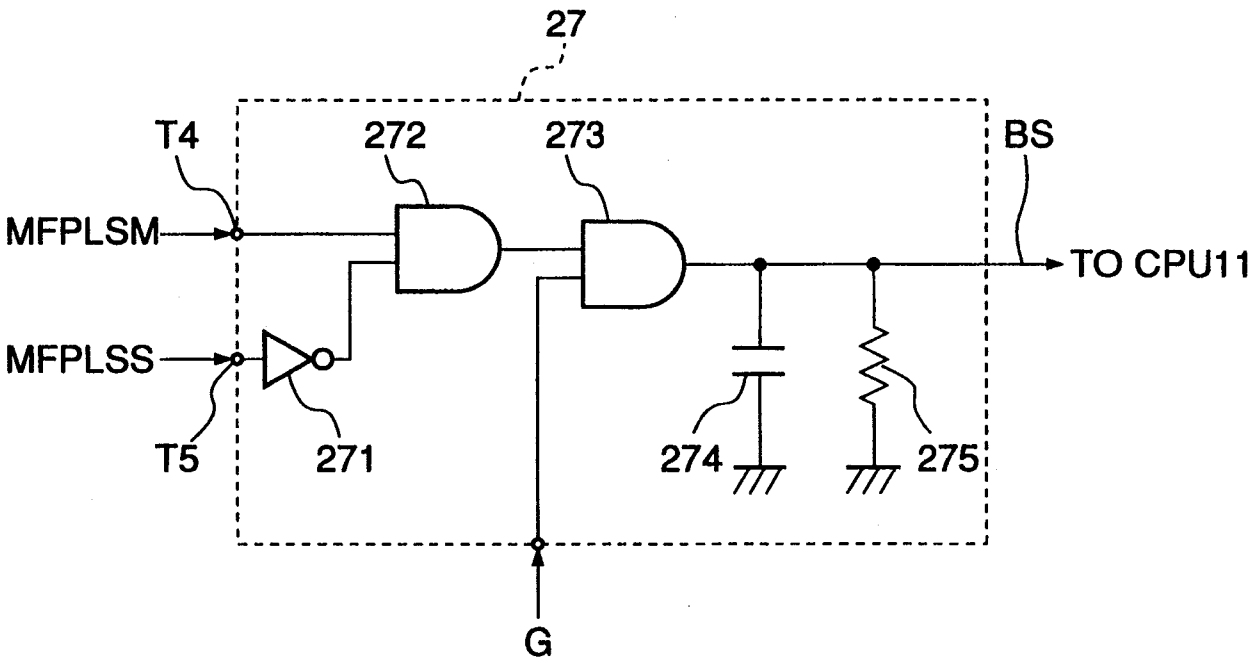
FIG. 4 is a circuit diagram showing details of other parts of the misfire-determining circuit.

FIG. 4 shows details of the construction of the determination result signal-forming circuit 27 in FIG. 2. The circuit 27 is composed of an invertor 271, AND gates 272, 273, a capacitor 274, and a resistance 275. One input terminal of the AND gate 272 is connected to the terminal T4 and the other input terminal thereof is connected via the invertor 271 to the terminal T5. The AND gate 273 has an input terminal thereof connected to the output of the AND gate 272 and the other input terminal to the CPU 11 to be supplied with an output from the AND gate 272 and a gating signal G at a high level from the CPU 11, respectively. The output of the AND gate 273 is grounded via the capacitor 274 and the resistance 275 which are connected in parallel.

The circuit of FIG. 4 operates as follows: While the gating signal G at a high level is supplied, i.e. during a predetermined time period provided in the vicinity of the termination of discharge caused by generation of the ignition command signal A, if the output MFPLSM from the first comparator 25 is at a high level and at the same time the output MFPLSS from the second comparator 26 is at a low level, i.e. if normal firing takes place within the cylinder, the AND gate 272 generates a high level output and hence the output from the AND gate 273 assumes a high level so that the determination result signal BS outputted from the AND gate 273 assumes a high level. When the logical relationship between the outputs MFPLSM and MFPLSS is other than that mentioned above, i.e. when a misfire has occurred in the cylinder, the output from the AND gate 272 assumes a low level so that the determination result signal BS remains low in level. Since as mentioned above, the misfire-determining time is limited within the above-mentioned predetermined time period set by the, gating signal G within which the sparking voltage largely varies between when normal firing occurs and when a misfire occurs, misfire detection can be made with high accuracy and high reliableness.

Figures 5A, 5B, 5C, 5D, 5E, 5F:
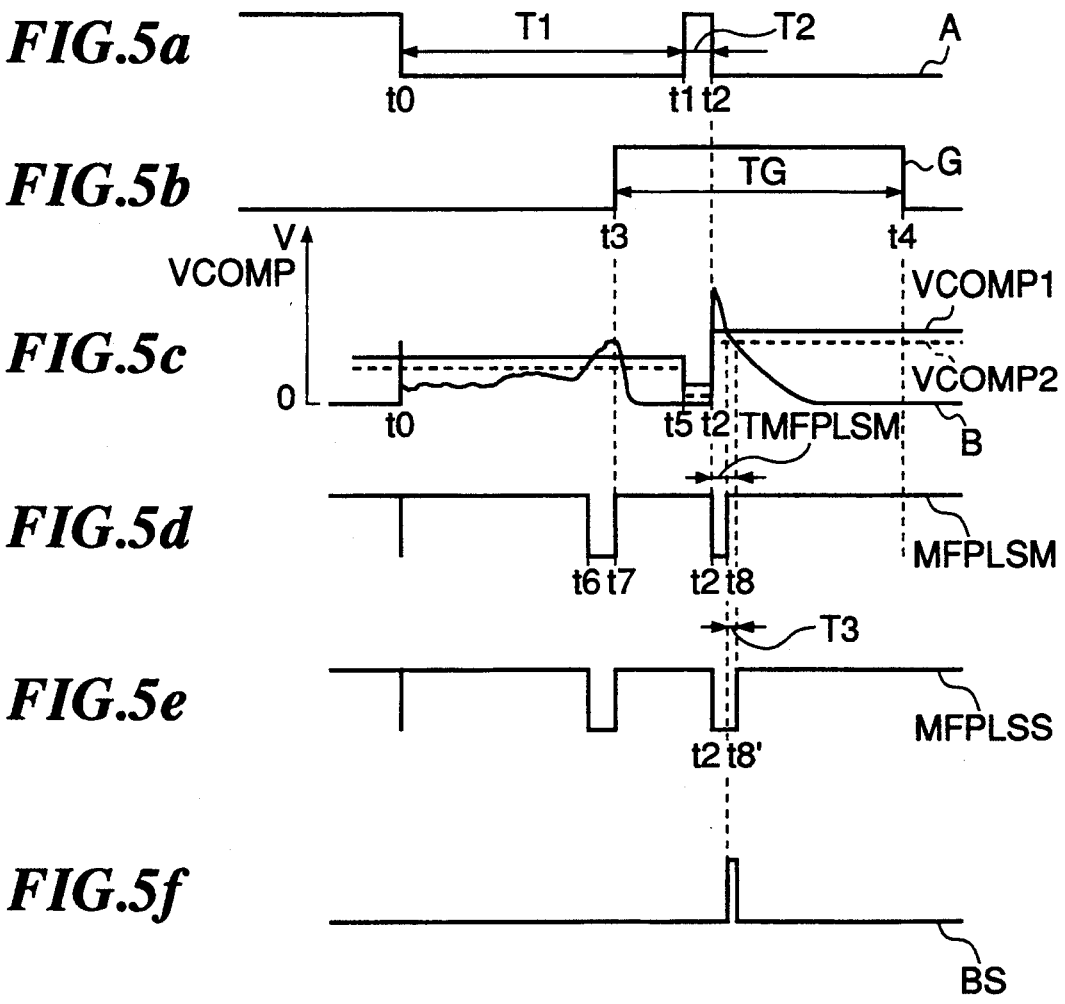
Figures 6A, 6B, 6C, 6D, 7A, 7B, 7C, 7D:
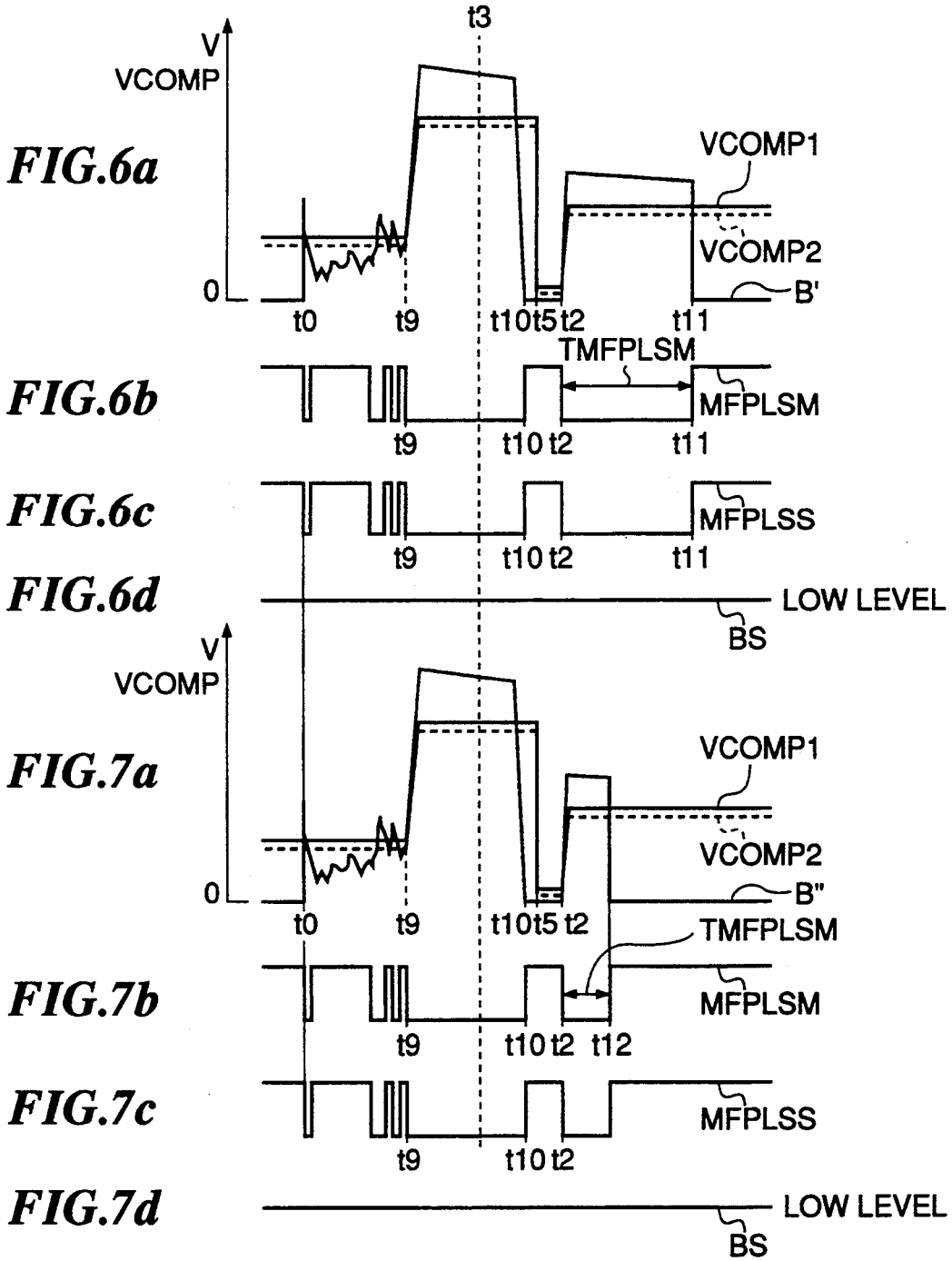

The operation of the misfire-detecting system constructed as above according to the present embodiment will now be explained in detail with reference to a timing chart formed by FIG. 5*a* to FIG. 5*f*, one formed by FIG. 6*a* to FIG. 6*d*, one formed by FIG. 7*a* to FIG. 7*d*, and FIG. 8. FIGS. 5*a* and 5*b* show the energization control signal A and the gating signal G, respectively. FIG. 5*c* to FIG. 5*f* show operation at normal firing, while FIG. 6*a* to FIG. 6*d* show operation at a misfire attributable to the fuel supply system (hereinafter referred to as "FI misfire"). Further, FIG. 7*a* and FIG. 7*b* show characteristics of the sparking voltage exhibited at an FI misfire when dielectric breakdown of the mixture occurs due to recharging of the ignition coil while a misfire has occurred.

As shown in FIG. 5*a*, according to the present embodiment, after the ignition command signal is generated at a time point t0, i.e. after the supply of current to the primary coil 2 is cut off after the coil 2 has been energized for a time period required for causing spark ignition, the coil 2 is again energized from a time point t1 to a time point t2 (hereinafter referred to as "reenergization"). This reenergization is carried out in such a manner that a voltage is applied between the electrodes of the spark plug 5 at the time point t2, which has such a low predetermined value as does not cause discharge between the electrodes, whereby electric charge is stored in floating capacitance between the spark plug 5 and its peripheral circuit parts (recharging). The voltage applied to the spark plug 5 at the time point t2 will be hereinafter referred to as the recharging voltage.

A sparking voltage characteristic obtainable in the case of normal firing will be explained with reference to FIG. 5*c*. FIG. 5*c* shows a change in the detected sparking voltage (output voltage from the output circuit 21) V (B) and changes in the comparative levels VCOMP1, VCOMP2 with the lapse of time.

Immediately after the time point t0 the ignition command signal A is generated, sparking voltage V rises to such a level as to cause dielectric breakdown of the mixture between the electrodes of the spark plug, i.e. across the discharging gap of the spark plug. After occurrence of the dielectric breakdown, the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow. The inductive discharge voltage rises with an increase in the pressure within the engine cylinder caused by the compression stroke of the piston executed after the time point t0, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge (late-stage capacitive discharge) occurs. In this capacitive discharge state, the voltage between the spark plug electrodes again rises, i.e. in the direction of causing dielectric breakdown of the mixture. However, since the ignition coil 1 then has a small amount of residual energy, the amount of rise of the voltage is small. This is because the electrical resistance of the discharging gap is low due to ionizing of the mixture during firing.

In this connection, at normal firing, the charge stored in the floating capacitance between the diode 7 and the spark plug (i.e. residual charge left after the discharge) is not discharged toward the ignition coil 1 due to the presence of the diode 7, but neutralized by ions present in the vicinity of the electrodes of the spark plug 5, so that the sparking voltage V declines after the termination of the capacitive discharge.

Thereafter, when the recharging voltage is applied to the spark plug at the time point t2, the sparking voltage V again rises. Similarly to the state immediately after termination of the late-stage capacitive discharge, the electric charge charged in the floating capacitance by the application of the recharging voltage is neutralized by ions present in the vicinity of the electrodes of the spark plug 5 to decline. Since then the sparking voltage V is not so high, it declines relatively gently as compared with the case where a misfire has occurred, hereinafter described.

The comparative levels VCOMP1, VCOMP2 obtained from the peak held value of the sparking voltage V assume, until a time point t5, values corresponding to a peak-held value of sparking voltage V obtained after resetting of the peak-holding circuit 22 on the last occasion, in the illustrated example. When the peak-holding circuit 22 is reset at the time point t5 by the resetting signal R1, the comparative levels VCOMP1, VCOMP2 are held at predetermined low levels (>0 volts) until the time point t2, whereupon the predetermined low levels or reset state is canceled (hereinafter, the timing of canceling the predetermined low level state will be referred to as "the resetting (initialization) timing"). Therefore, after the time point t2 the comparative levels VCOMP1, VCOMP2 show values dependent on a peak value of the sparking voltage V caused by the recharging voltage after the peak-holding circuit 22 was reset at the time point t5. In the present embodiment, the comparative levels VCOMP1, VCOMP2 are set to values corresponding to a peak value of sparking voltage caused by the recharging voltage. As a result, the output MFPLSM from the first comparator 25 which compares between the sparking voltage V and the comparative level VCOMP1 assumes a high level at or about the time point t0, between time points t6 and t7, and between time points t2 and t8, as shown in FIG. 5*d*, whereas, as shown in FIG. 5*e*, the output MFPLSS from the second comparator 26 which compares between the sparking voltage V and the second comparative level VCOMP2 changes in the same manner as the first comparative level VCOMP1 before the recharging voltage is applied and then assumes a low level over a longer time period than in the case of the output MFPLSM between time points t2 and t8' after the application of the recharging voltage within the gating time TG during which the gating signal G is at a low level. Accordingly, the determination result signal BS from the determination result signal-forming circuit 27 assumes a high level over a time period T3 (FIG. 5*e*) by which the output MFPLSS is longer than the output MFPLSM, i.e. the time interval between t8 and t8', as shown in FIG. 5*f*, and the high pulse signal BS is supplied to the CPU 11. Responsive to the input high pulse signal, BS, the CPU 11 sets a flag FION to "1" by a routine, not shown, which flag will be used in a misfire-determining routine, as hereinafter described.

Next, a sparking voltage characteristic will be described, which is obtained when an FI misfire occurs, i.e. no firing occurs, due to supply of a lean mixture to the engine or cutting-off of the fuel supply to the engine caused by faulty operation of the fuel supply system, etc. In FIG. 6*a*, immediately after the time point t0 of generation of the ignition command signal A, the sparking voltage V (B') rises above a level causing dielectric breakdown of the mixture. In this case, the ratio of air in the mixture is greater than when the mixture supplied to the engine has an air-fuel ratio close to the stoichiometric ratio, and accordingly the dielectric strength of the mixture is high. Besides, since the mixture is not fired, it is not ionized so that the electrical resistance of the discharging gap of the spark plug is high. Consequently, the sparking voltage becomes higher than that obtained in the case of normal firing of the mixture. Thereafter, the discharge state shifts to an inductive discharge state, as in the case of normal firing. However, the electrical resistance of the discharging gap of the spark plug at the discharge is greater in the case of supply of a lean mixture, etc. than that in the case of normal firing so that the inductive discharge state tends to shift to a capacitive discharge state earlier than in the case of normal firing. The sparking voltage V caused by the capacitive discharge occurring after termination of the inductive discharge (late-stage capacitive discharge) is much higher than that at normal firing, because the voltage of dielectric breakdown of the mixture is higher than that at normal firing.

On this occasion, almost no ion is present in the vicinity of the electrodes of the spark plug 5 so that the charge stored between the diode 7 and the spark plug 5 is not neutralized, nor is it allowed to flow backward to the ignition coil 1 due to the presence of the diode 7. Therefore, the charge is held as it is without being discharged through the electrodes of the spark plug 5. Then, when the pressure within the engine cylinder lowers so that the voltage between the electrodes of the spark plug 5 required for discharge to occur becomes equal to the voltage applied by the charge, there occurs a discharge between the electrodes of the spark plug 5. As the sparking voltage V is higher, the discharge takes place earlier.

Thereafter, at the time point t2, the recharging voltage is applied to the spark plug 5. As a result, the sparking voltage V again rises. On this occasion, as mentioned above, there is almost no ion present between the electrodes of the spark plug and hence the charge stored between the diode 7 and the spark plug 5 is not neutralized, so that the sparking voltage V is held in a high voltage state due to the presence of the diode 7. As the pressure within the cylinder further lowers so that the voltage between the electrodes of the spark plug 5 required for discharge to occur becomes equal to the voltage applied by the charge, there occurs a discharge between the electrodes of the spark plug 5 and the sparking voltage V falls very quickly (at a time point t11).

On the other hand, the comparative levels VCOMP1, VCOMP2 assume, until a time point t9, values corresponding to a peak-held value of sparking voltage V obtained after resetting of the peak-holding circuit 22 on the last occasion, in the illustrated example. After the the point t9, the comparative level VCOMP rises with a rise in the sparking voltage V and thereafter is maintained at values dependent upon a peak value of the sparking voltage V until the time point t5. When the peak-holding circuit 22 is reset at the time point t5 by the resetting signal R1, the comparative levels VCOMP1, VCOMP2 fall and are thereafter held at predetermined low levels (>0 volts) until the time point t2. After the time point t2 the comparative levels VCOMP1, VCOMP2 are maintained at values dependent on a peak value of the sparking voltage V caused by the application of the recharging voltage. As a result, the outputs MFPLSM, MFPLSS from the first and second comparators 25 assume a low level at or about the time point t0, slightly before the time point t9, between the time point t9 and the time point t10 and between the time point t2 and the time point t11, as shown in FIGS. 6*b* and 6*c*. Accordingly, the determination result signal BS remains low in level during the whole discharge time, as shown in FIG. 6*d*. Therefore, the flag FION is never set to "1".

Next, reference is made to FIGS. 7*a* to 7*d* to explain a sparking voltage characteristic obtained when dielectric breakdown of the mixture occurs due to the recharging while at the same time a misfire occurs.

In this case, the sparking voltage exhibits almost the same characteristic as one obtained in the case of a normal FI misfire without dielectric breakdown of the mixture, shown in FIG. 6*a*, before the time point t2 at which the recharging voltage is applied to the spark plug 5, as shown in FIG. 7*a*. However, when dielectric breakdown of the mixture occurs at a time point t12 after the time point t2, the sparking voltage V (B'') suddenly falls, as shown in FIG. 7*a*. Accordingly, the outputs MFPLSM, MFPLSS from the first and second comparators 25, 26 change as shown in FIGS. 7*b* and 7*c*. More specifically, they both assume a low level at or about the time point t0, slightly before the time point t9, between the time points t9 and t10, and between the time points t2 and t12. Consequently, the determination result signal BS remains at a low level during the whole discharge time. Therefore, the flag FION is never set to "1".

The manner of misfire determination according to the present embodiment will now be described with reference to FIG. 8.

First, at a step S1 in the figure, it is determined whether or not the pulse base width (base line dwell-time) TMFPLSM of the output signal MFPLSM from the first comparator 25, which falls at the time point t2 as shown in FIGS. 5, 6 and 7, is longer than a predetermined time period TMFPLSMA. If the answer is affirmative (YES), it is determined at a step S2 that a normal FI misfire has occurred while no dielectric breakdown of the mixture occurs, which misfire was described with reference to FIG. 6*b*.

If the answer to the question of the step S1 is negative (NO), i.e. if the pulse base width TMFPLSM is equal to or shorter than the predetermined time period TMFPLSMA, it is presumed that the mixture has been normally fired or dielectric breakdown of the mixture has occurred while at the same time an FI misfire has occurred, and then the program proceeds to a step S3. At the step S3, it is determined whether or not the flag FION has been set to "1". If the flag FION has been set to "1" it is determined at a step S4 that the mixture has been normally fired. If it is determined at the step S3 the flag has not been set to "1", it is determined at the step S2 that an FI misfire has occurred. In this case, dielectric breakdown of the mixture has occurred due to the recharging of the ignition coil 1.

Figure 9:
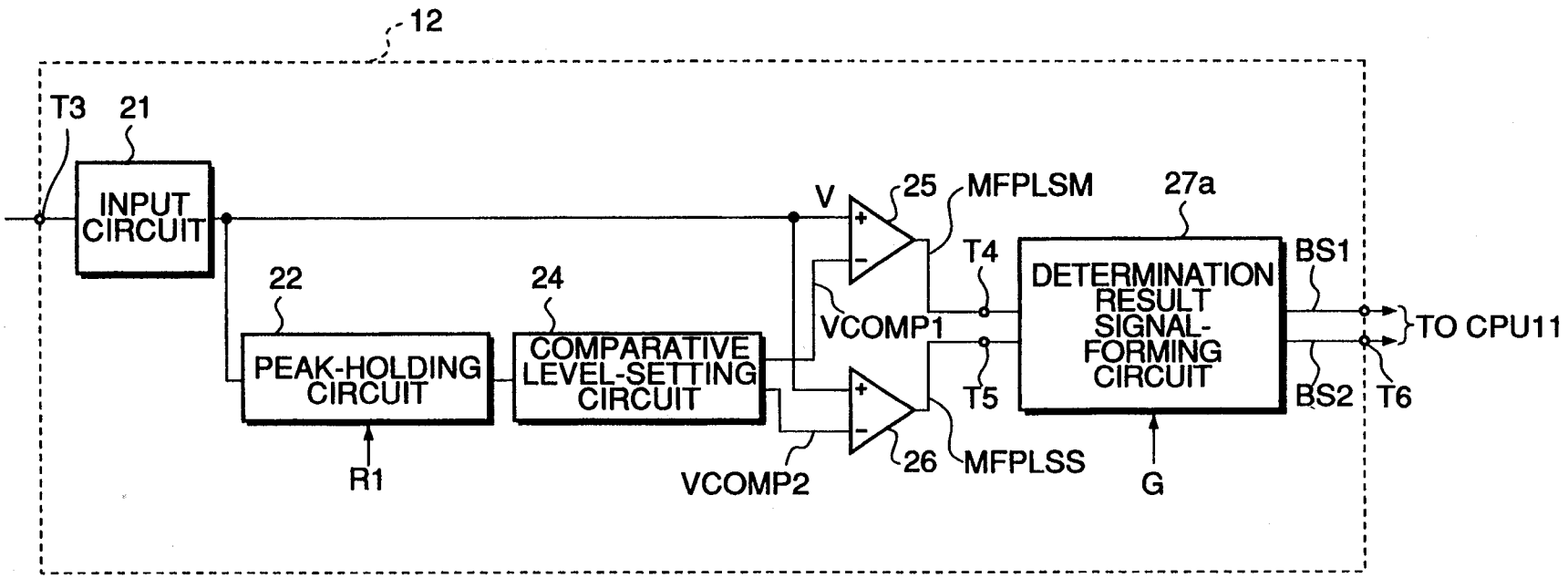
FIG. 9 is a circuit diagram showing the arrangement of a misfire-determining circuit of a misfire-detecting system according to a second embodiment of the engine.

FIG. 9 shows essential parts of a misfire-detecting system according to a second embodiment of the invention.

The second embodiment is distinguished from the first embodiment described above in that a determination result signal-forming circuit 27*a* is provided in place of the circuit 27, which has a different function from the latter. In FIG. 9, the other elements and parts are identical with those in FIG. 2, description of which is therefore omitted.

Figure 10:
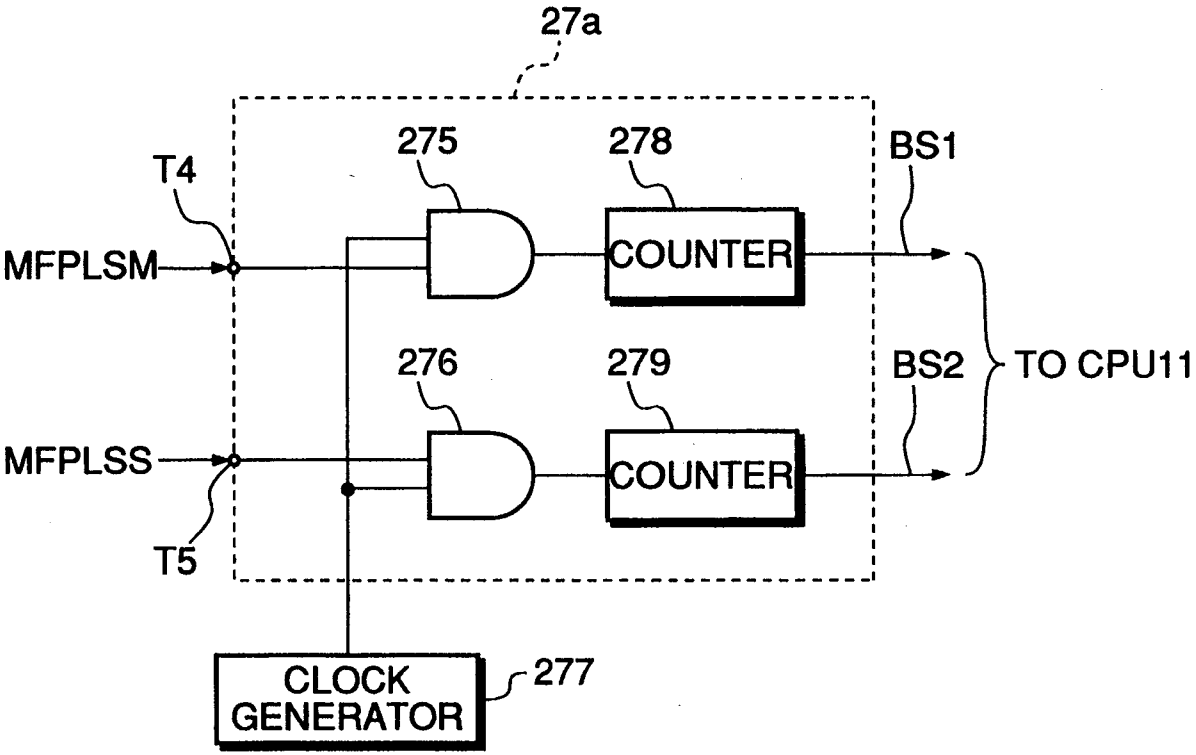
FIG. 10 is a circuit diagram showing details of essential parts of the misfire-determining circuit of FIG. 9.

The determination result signal-forming circuit 27*a* is constructed as shown in FIG. 10. It is comprised of AND gates 275, 276, a clock generator circuit 277, and counters 278, 279. The terminals T4, T5 through which the outputs MFPLSM, MFPLSS from the first and second comparators 25, 26 in FIG. 2 are supplied are connected to input terminals of the AND gates 275, 276, while the clock generator circuit 277 is connected to the other input terminals of the AND gates 275, 276. The outputs of the AND gates are connected to inputs of the counters 278, 279, which in turn have their outputs connected to the CPU 11 in FIG. 1.

In the determination result pulse-forming circuit 27*a* constructed as above, the pulse widths of the outputs MFPLSM, MFPLSS are counted by the respective counters 278, 279, and the count values BS1, BS2 are supplied to the CPU 11.

Figure 11:
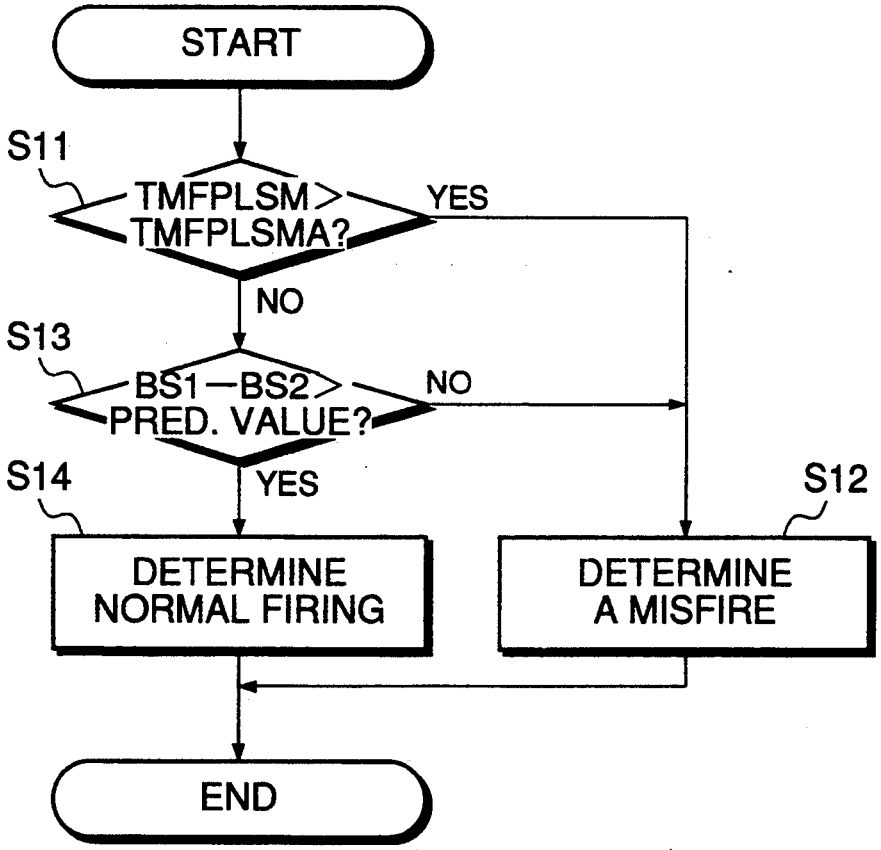
FIG. 11 is a flowchart for detecting a misfire, according to the second embodiment.

The manner of misfire determination according to the second embodiment will now be described with reference to FIG. 11 showing a program for carrying out the misfire determination.

Figure 8:
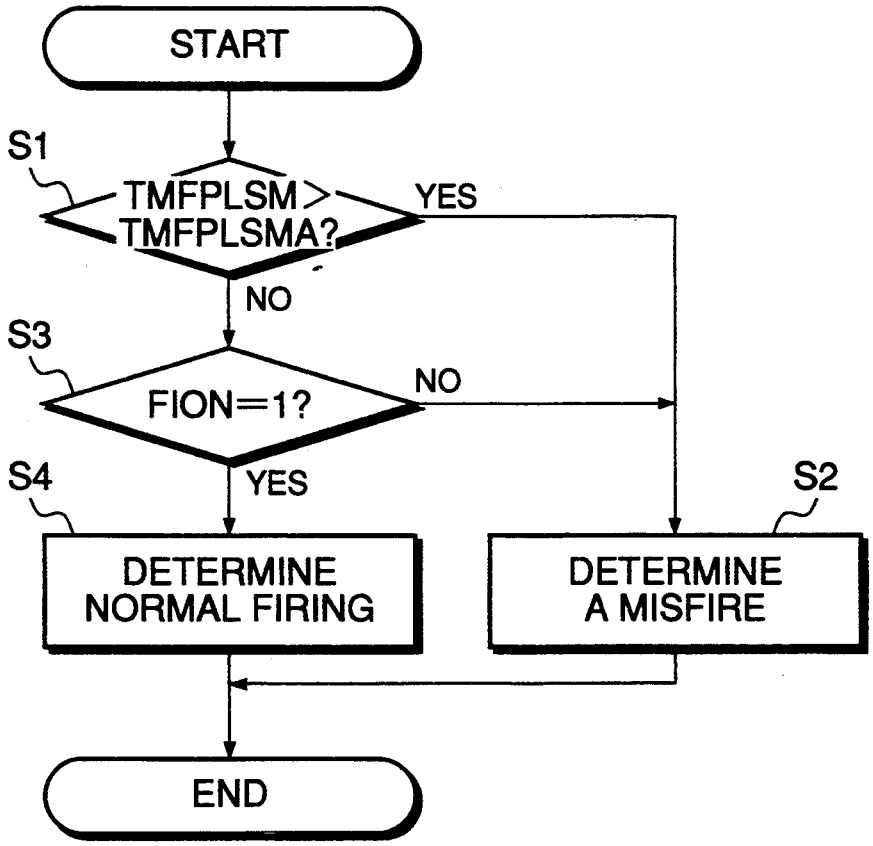
FIG. 8 is a flowchart of a program for detecting a misfire in the engine according to the first embodiment.

First, at a step S11, similarly to the step S1 in FIG. 8 of the first embodiment, it is determined whether or not the pulse base width (base line dwelltime) TMFPLSM of the output signal MFPLSM from the first comparator 25 is longer than the predetermined time period TMFPLSMA. If the answer is affirmative (YES), it is determined at a step S12 that a normal FI misfire has occurred while no dielectric breakdown of the mixture occurs.

If the answer to the question of the step S11 is negative (NO), i.e. if the pulse base width TMFPLSM is equal to or shorter than the predetermined time period TMFPLSMA, it is presumed that the mixture has been normally fired or dielectric breakdown of the mixture has occurred while at the same time an FI misfire has occurred, and then the program proceeds to a step S13. At the step S13, it is determined whether or not the difference BS1–BS2 between the count value BS1 from the counter 278 and the count value BS2 from the counter 279 is larger than a predetermined value. The difference BS1–BS2 corresponds to the time period T3 in FIG. 5*e*. The predetermined value is set depending upon operating conditions of the engine determined by the engine rotational speed, load on the engine, etc. If the difference BS1–BS2 is larger than the predetermined value, it is determined at a step S14 that the mixture has been normally fired, whereas if the difference BS1–BS2 is equal to or smaller than the predetermined value, it is determined at a step S12 that a misfire has occurred while no breakdown due to the recharging has occurred. By thus determining occurrence of a misfire based upon the difference between the count values BS1, BS2, an error in the misfire determination which is caused by an external disturbance such as noise can be prevented, to enable more accurate detection of a misfire.

What is claimed is:

1. A misfire-detecting system for an internal combustion engine having at least one spark plug, comprising:

engine operating parameter-detecting means for detecting operating parameters of said engine;

ignition command signal-generating means for determining ignition timing based on the detected operating parameters of said engine and for generating an ignition command signal at said ignition timing;

igniting means responsive to said ignition command signal for generating high voltage for causing electric discharge of said at least one spark plug;

sparking voltage-detecting means for detecting sparking voltage when said high voltage is generated by said igniting means;

first comparator means for comparing the detected sparking voltage with a first predetermined comparative level;

second comparator means for comparing the detected sparking voltage with a second predetermined comparative level which is lower than said first predetermined comparative level; and misfire-determining means for determining whether a misfire has occurred in said engine, based upon a logical relationship between results of said comparisons by said first and second comparator means.

2. A misfire-detecting system as claimed in claim 1, wherein said misfire-determining means comprises invertor means for inverting an output from one of said first and second comparator means, and AND means for determining a conjunction (AND) between the inverted output from said one of said first and second comparator means and an output from the other comparator means.

3. A misfire-detecting system as claimed in claim 1, including comparison time-limiting means for limiting a time period within which said comparisons by said first and second comparator means are to be carried out, and wherein said misfire-determining means carries out said determination as to occurrence of a misfire within the limited time period.

4. A misfire-detecting system as claimed in claim 2, wherein said misfire-determining means includes means for determining whether a time period over which an output from one of said first and second comparator means exceeds said first or second predetermined comparative level is longer than a predetermined time period, and wherein said misfire-determining means determines that a misfire has occurred, when said time period is longer than said predetermined time period or when said time period is not longer than said predetermined time period and at the same time said conjunction (AND) is equal to a predetermined conjunction value.

5. A misfire-detecting system for an internal combustion engine having at least one spark plug, comprising:

engine operating parameter-detecting means for detecting operating parameters of said engine;

ignition command signal-generating means for determining ignition timing based on the detected operating parameters of said engine and for generating an ignition command signal at said ignition timing;

igniting means responsive to said ignition command signal for generating high voltage for causing electric discharge of said at least one spark plug;

sparking voltage-detecting means for detecting sparking voltage when said high voltage is generated by said igniting means;

first comparator means for comparing the detected sparking voltage with a first predetermined comparative level;

second comparator means for comparing the detected sparking voltage with a second predetermined comparative level which is lower than said first predetermined comparative level;

first measuring means for measuring a first time period over which said output from said first comparator means indicates that the detected sparking voltage exceeds said first predetermined comparative level;

second measuring means for measuring a second time period over which said output from said second comparator means indicates that the detected sparking voltage exceeds said second predetermined comparative level; and misfire-determining means for determining whether a misfire has occurred, based upon a difference between said first and second time periods measured by said first and second measuring means.

6. A misfire-detecting system as claimed in claim 5, including comparison time-limiting means for limiting a time period within which said comparisons by said first and second comparator means are to be carried out, and wherein said misfire-determining means carries out said determination as to occurrence of a misfire within the limited time period.

7. A misfire-detecting system as claimed in claim 5, wherein said misfire-determining means includes means for determining whether a time period over which an output from one of said first and second comparator means exceeds said first or second predetermined comparative level is longer than a predetermined time period, and wherein said misfire-determining means determines that a misfire has occurred, when said time period is longer than said predetermined time period or when said time period is not longer than said predetermined time period and at the same time said difference between said first and second time periods is smaller than a predetermined time period value.

8. A misfire-detecting means as claimed in claim 1, including recharging means for applying recharging voltage to said at least one spark plug after generation of said ignition command signal, said recharging voltage having such a voltage value as does not cause electric discharge of said at least one spark plug.

9. A misfire-detecting means as claimed in claim 5, including recharging means for applying recharging voltage to said at least one spark plug after generation of said ignition command signal, said recharging voltage having such a voltage value as does not cause electric discharge of said at least one spark plug.

* * * * *